US011656034B2

(12) United States Patent
Li et al.

(10) Patent No.: US 11,656,034 B2
(45) Date of Patent: May 23, 2023

(54) POSITIVE-PRESSURE-WITHSTANDING HIGH-POWER FLAT EVAPORATOR, PROCESSING METHODS THEREOF AND FLAT LOOP HEAT PIPE BASED ON EVAPORATOR

(71) Applicant: BEIJING INSTITUTE OF SPACECRAFT SYSTEM ENGINEERING, Beijing (CN)

(72) Inventors: Guoguang Li, Beijing (CN); Hongxing Zhang, Beijing (CN); Guanglong Man, Beijing (CN); Shuai Wang, Beijing (CN); Dongxiao Liu, Beijing (CN)

(73) Assignee: BEIJING INSTITUTE OF SPACECRAFT SYSTEM ENGINEERING, Beijing (CN)

( * ) Notice: Subject to any disclaimer, the term of this patent is extended or adjusted under 35 U.S.C. 154(b) by 287 days.

(21) Appl. No.: 16/831,723

(22) Filed: Mar. 26, 2020

(65) Prior Publication Data

US 2020/0326132 A1 Oct. 15, 2020

Related U.S. Application Data

(63) Continuation of application No. PCT/CN2017/000656, filed on Oct. 31, 2017.

(30) Foreign Application Priority Data

Sep. 27, 2017 (CN) ..... 201710887521.7

(51) Int. Cl.
*F28D 15/04* (2006.01)

(52) U.S. Cl.
CPC ..... *F28D 15/04* (2013.01)

(58) Field of Classification Search
CPC ..... F28D 15/04; F28D 15/043; F28D 15/046
USPC ..... 165/104.26
See application file for complete search history.

(56) References Cited

U.S. PATENT DOCUMENTS 6,330,907 B1 * 12/2001 Ogushi ..... F28D 15/043 165/104.26
7,748,436 B1 * 7/2010 Anderson ..... F28D 15/0266 165/104.26
2007/0187072 A1 * 8/2007 Chin ..... F28D 15/043 165/104.26
2009/0314472 A1 * 12/2009 Kim ..... F28D 15/043 165/104.26

(Continued)

*Primary Examiner* — Tho V Duong
(74) *Attorney, Agent, or Firm* — Yong Chen

(57) ABSTRACT

The present disclosure provides a positive-pressure-withstanding high-power flat evaporator, processing methods thereof and a flat loop heat pipe including the evaporator. The evaporator includes a housing, and reinforcing ribs and a capillary wick which are positioned inside the housing, and the arrangement of the reinforcing ribs can ensure that the strength of the whole evaporator is capable of withstanding positive pressure. The capillary wick is composed of four parts, namely, an evaporating wick, a heat insulating wick, a sealing wick and a transfer wick. Through the large permeability of the transfer wick, liquid supply with low flow resistance can be realized, the heat transfer capability of the loop heat pipe is greatly improved, and the problems of long liquid supply path and large flow resistance caused by a large-area evaporator are solved.

8 Claims, 12 Drawing Sheets

F

(56) References Cited

U.S. PATENT DOCUMENTS

| | | | | |
|---|---|---|---|---|
| 2012/0043060 | A1* | 2/2012 | Wang | F28D 15/0266 165/104.26 |
| 2012/0137718 | A1* | 6/2012 | Uchida | F28D 15/043 62/259.2 |
| 2012/0247736 | A1* | 10/2012 | Xiang | F28D 15/0266 165/104.26 |
| 2018/0209746 | A1* | 7/2018 | Tsai | F28D 15/043 |

* cited by examiner

POSITIVE-PRESSURE-WITHSTANDING HIGH-POWER FLAT EVAPORATOR, PROCESSING METHODS THEREOF AND FLAT LOOP HEAT PIPE BASED ON EVAPORATOR

CROSS REFERENCE TO RELATED APPLICATION

This application is a continuation of international application PCT/CN2017/000656, filed Oct. 31, 2017, which claims priority to Chinese Patent Application No. 201710887521.7 filed Sep. 27, 2017. The disclosures of these prior-filed applications are incorporated by reference in their entireties.

FIELD

The present disclosure relates to an efficient heat transfer element and a processing method thereof, in particular to a flat loop heat pipe evaporator and processing methods thereof, and belongs to the technical field of heat dissipation of spacecraft and other electronic equipment on the ground.

BACKGROUND

A loop heat pipe is an efficient two-phase heat transfer device, which has high heat transfer performance, long-distance heat transfer capacity, excellent temperature control property, and high pipe bending flexibility, and is convenient to install. Due to the advantages that many other heat transfer devices do not have, loop heat pipes have a very broad application prospect in many fields such as heat dissipation of spacecraft and ground electronic equipment.

As shown in FIG. 1, a loop heat pipe mainly comprises an evaporator, a condenser, a reservoir, a vapor line and a liquid line. The whole circulation process is as follows: liquid evaporates on the outer surface of a capillary wick in the evaporator and absorbs the heat outside the evaporator; the generated vapor flows to the condenser from the vapor line, releases heat in the condenser to a heat sink and is condensed into liquid; and the liquid finally flows into the reservoir through the liquid line, and a liquid working fluid in the reservoir maintains the supply to the capillary wick in the evaporator.

A structure of a traditional loop heat pipe evaporator is shown in FIG. 2, comprising a housing and a capillary wick arranged inside the housing, wherein the outer circumference of the capillary wick is provided with vapor channels, and the vapor channels communicate with a vapor line; and a central hole of the capillary wick communicates with a reservoir to serve as a main liquid line, and a liquid guiding pipe communicating with the liquid line is positioned at the central hole of the capillary wick. The capillary wick is the core part of the evaporator, and its main function is as follows: the surface, contacting with a heat source, of the porous capillary wick is taken as an evaporation surface, capillary pores of the evaporation surface form a meniscus to provide capillary driving force for driving the circulation of a working fluid, and liquid is transferred to the evaporator through the capillary wick after cyclically flowing into the reservoir.

A flat loop heat pipe is a research hotspot and important application direction in recent years due to its small installation space and easy installation of an evaporator and a heat source plane. Further, a rectangular flat loop heat pipe has greater advantages because it can be made thinner as the reservoir is located at one side of the evaporator.

There are currently two technical problems in the development of flat loop heat pipes:

(1) At present, most of the rectangular flat loop heat pipes reported in the literature use working fluids such as water and acetone, which are under negative pressure or slightly positive pressure during operation and have no requirement on evaporator structure in term of pressure resistance. However, in order to have good heat transfer performance and a suitable working temperature zone, flat loop heat pipes would also need positive pressure working fluids with high quality factors such as ammonia and freon, the requirement of which cannot be met by conventional structural strength. No published research literature on positive-pressure rectangular flat loop heat pipes has been seen to date.

(2) With the increase of heat dissipation power and heat collection area, a flat loop heat pipe evaporator coupled with a heat source also needs to have a matching large area, requiring greater heat transfer capability in performance. Under the condition that the thickness of the evaporator does not increase, on the one hand, a large heat transfer amount means a larger circulating flow rate of working fluids, resulting in larger flow resistance of liquid supplied from a reservoir to the evaporator; and on the other hand, the larger evaporator area also increases the length of the flow path of the liquid supply, resulting in an increase in resistance. The increase of resistance will lead to the decrease of heat transfer capability. Therefore, how to increase the evaporator area and improve heat transfer capability at the same time is another key issue in the development of the flat loop heat pipe technology.

SUMMARY

In view of the above, the present disclosure provides a positive-pressure-withstanding, high-power flat loop heat pipe evaporator, which utilizes a composite capillary wick structure to improve heat transfer capability, and solves the problem of pressure withstanding capability when a flat loop heat pipe uses a positive-pressure working fluid and the technical problem of improving heat transfer capability without increasing thickness.

The positive-pressure-withstanding high-power flat evaporator comprises a housing and a capillary wick arranged inside the housing, wherein one or more reinforcing ribs are arranged inside the housing, and the reinforcing ribs are positioned at the middle section of the housing, that is, the two ends of each reinforcing rib in a length direction do not extend out of the housing;

the capillary wick is of a rectangular structure consistent with an inner cavity structure of the housing, and comprises an evaporating wick, a heat insulating wick and a transfer wick; the evaporating wick is used for providing a capillary force, and vapor channels having the same length as the evaporating wick are arranged on the end surface of one side of the evaporating wick;

the space formed by a gap between one end of the evaporating wick in a length direction and the inner surface of the housing is an air accumulation chamber; the other end of the evaporating wick in the length direction is provided with the heat insulating wick for blocking heat leakage from the evaporator to a reservoir;

the transfer wick is arranged on the surface, opposite to the surface on which the vapor channels are positioned, of the evaporating wick, and the transfer wick is used for realizing low-flow-resistance liquid transfer from the reservoir to the evaporating wick; and the end, close to the air accumulation chamber side, of the transfer wick does not penetrate through the evaporating wick and is wrapped by the evaporating wick.

As a preferred mode of the present disclosure, the positive-pressure-withstanding high-power flat evaporator further comprises a sealing wick arranged at the end of the heat insulating wick for sealing the heat insulating wick.

The present disclosure further provides a processing method of a positive-pressure-withstanding high-power flat loop heat pipe evaporator:

(1) vertically placing vapor channel tools on a boss located on the upper surface of a limiting tool, and then installing the housing on the boss located on the upper surface of the limiting tool such that the vapor channel tools are all positioned in the housing, and attaching the vapor channel tools to the end surface of one side of the housing; where the housing is provided with reinforcing ribs inside;

(2) filling the housing with powder required for an evaporating wick with a predetermined filling thickness, so as to form a front end of the evaporating wick;

(3) inserting a screen or sintered felt matched with the inner wall of the housing in size into the housing, and attaching it to a side opposite to the vapor channel tools to serve as a transfer wick;

(4) continuing to fill powder required for the evaporating wick into the housing until the powder is flush with the tops of the vapor channel tools, so as to form a rear end of the evaporating wick; wherein the front end of the evaporating wick and the rear end of the evaporating wick jointly form the evaporating wick;

(5) filling the housing with powder required for a heat insulating wick with a predetermined thickness above the evaporating wick, so as to form the heat insulating wick;

(6) filling the housing with powder required for a sealing wick with a predetermined thickness above the heat insulating wick, so as to form the sealing wick;

(7) if the powder required for the evaporating wick, the powder required for the heat insulating wick or the powder required for the sealing wick needs to be sintered, placing the product formed in step (6) into a high-temperature furnace for sintering; and if the powder required for the heat insulating wick, the powder required for the evaporating wick and the powder required for the sealing wick are to be directly pressed, proceeding to the next step; and (8) demolding to obtain the evaporator.

The present disclosure further provides another processing method of a positive-pressure-withstanding high-power flat loop heat pipe evaporator:

(1) vertically placing vapor channel tools on a boss located on the upper surface of a limiting tool, and then installing a housing on the boss located on the upper surface of the limiting tool such that the vapor channel tools are all positioned in the housing, and attaching the vapor channel tools to the end surface of one side of the housing;

(2) filling the housing with powder required for an evaporating wick with a predetermined filling thickness, so as to form a front end of the evaporating wick;

(3) inserting a space occupying tool into the housing and attaching it to a side opposite to the vapor channel tools in the housing, wherein the space occupying tool is used for occupying the space for a transfer wick in advance;

(4) continuing to fill powder required for the evaporating wick into the housing until the powder is flush with the tops of the vapor channel tools, so as to form a rear end of the evaporating wick; wherein the front end of the evaporating wick and the rear end of the evaporating wick jointly form the evaporating wick;

(5) if the powder required for the evaporating wick needs to be sintered, sintering the powder for the evaporating wick; and if sintering is not required, proceeding to the next step;

(6) removing the space occupying tool, filling powder required for the transfer wick in the void previously taken by the space occupying tool, wherein the filling height is consistent with the height of the evaporating wick formed in step (4), so as to form the transfer wick;

(7) filling the housing with powder required for a heat insulating wick with a predetermined thickness above the evaporating wick, so as to form the heat insulating wick;

(8) filling the housing with powder required for a sealing wick with a predetermined thickness above the heat insulating wick, so as to form the sealing wick;

(9) if the powder required for the transfer wick, the powder required for the heat insulating wick or the powder required for the sealing wick needs to be sintered, placing the product formed in step (8) into a high-temperature furnace for sintering; and if the powder required for the transfer wick, the powder required for the heat insulating wick and the powder required for the sealing wick are to be directly pressed, proceeding to the next; and

(10) demolding to obtain the evaporator.

Finally, the present disclosure provides a positive-pressure-withstanding high-power flat loop heat pipe, comprising an evaporator, a condenser, a reservoir, a vapor line and a liquid line, and the evaporator is the positive-pressure-withstanding high-power flat evaporator described above.

Beneficial Effects (1) The evaporator in the present disclosure has a structure in which the middle section is provided with the reinforcing ribs and two through ends are provided, so that on the one hand, the ability to withstand pressure of the housing can be improved to adapt to a positive pressure working fluid; and on the other hand, the capillary wick in through spaces at the two ends can carry out self-regulation of flow to realize uniform liquid supply.

(2) The capillary wick further comprises the transfer wick which extends to the bottom of the evaporating wick, and through the large permeability of the transfer wick, liquid supply with low flow resistance can be realized, the heat transfer capability of the loop heat pipe is greatly improved, and the problems of long liquid supply path and large flow resistance caused by a large-area evaporator are solved.

(3) The transfer wick and the heat insulating wick with low thermal conductivity can reduce heat leakage of the evaporator to the reservoir, while having good permeability so as to reduce the flow resistance in the capillary wick and improve the operation stability of the product.

Wherein: 1—housing, 2—reinforcing rib, 3—evaporating wick, 4—heat insulating wick, 5—sealing wick, 6—transfer wick, 7—vapor channel.

DETAILED DESCRIPTION OF THE EMBODIMENTS

The present disclosure will be described in detail below with reference to the accompanying drawings and specific embodiments.

Embodiment 1

This embodiment provides a positive-pressure-withstanding high-power flat loop heat pipe evaporator, which adopts a composite capillary wick structure to improve heat transfer capability, solves the problem of pressure withstanding ability when an evaporator uses a positive-pressure working fluid, and has higher heat transfer capability without increased thickness.

Figure 1:
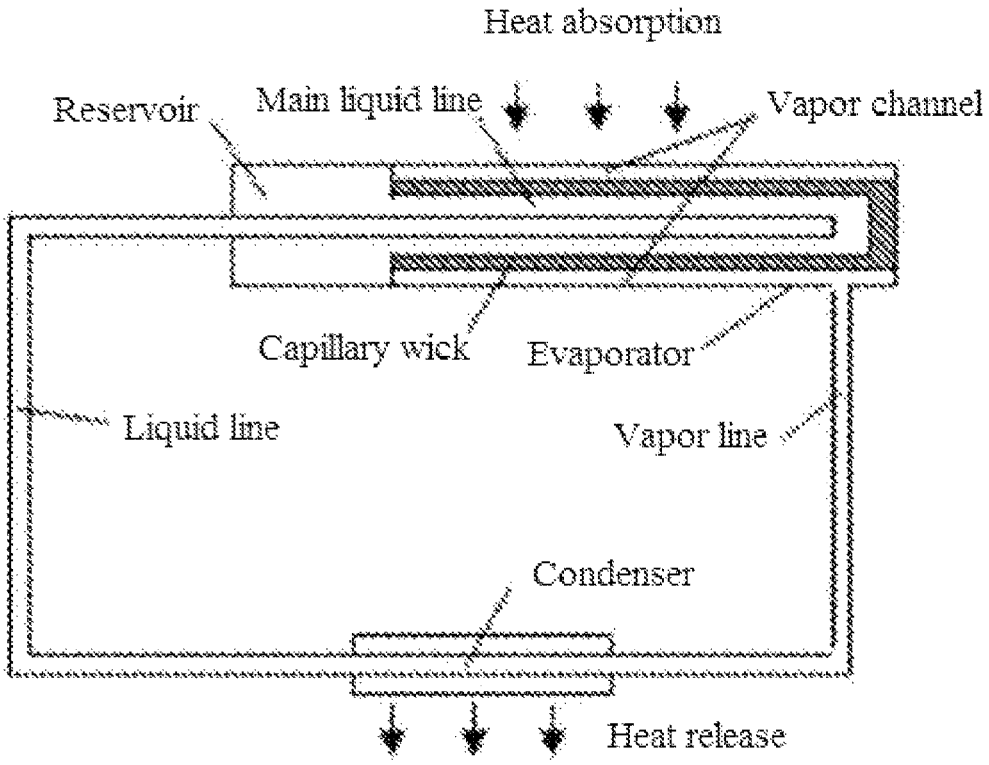
FIG. 1 (Prior Art)
FIG. 1 is a schematic structural diagram of a loop heat pipe in the prior art.
Figure 2:
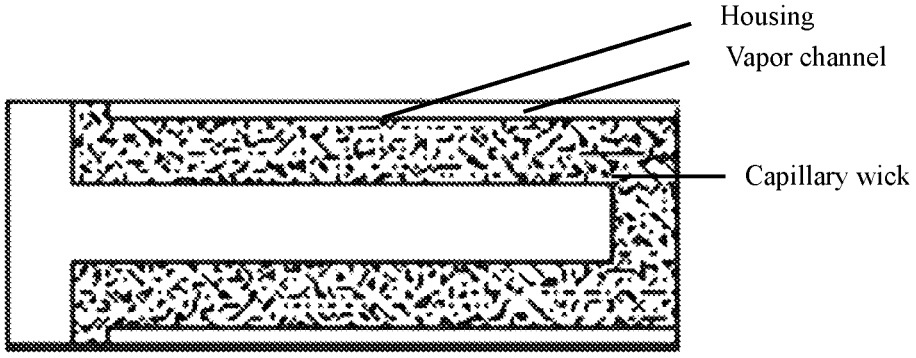
FIG. 2 (Prior Art)
FIG. 2 is a sectional view of an evaporator in the prior art.
Figure 3:
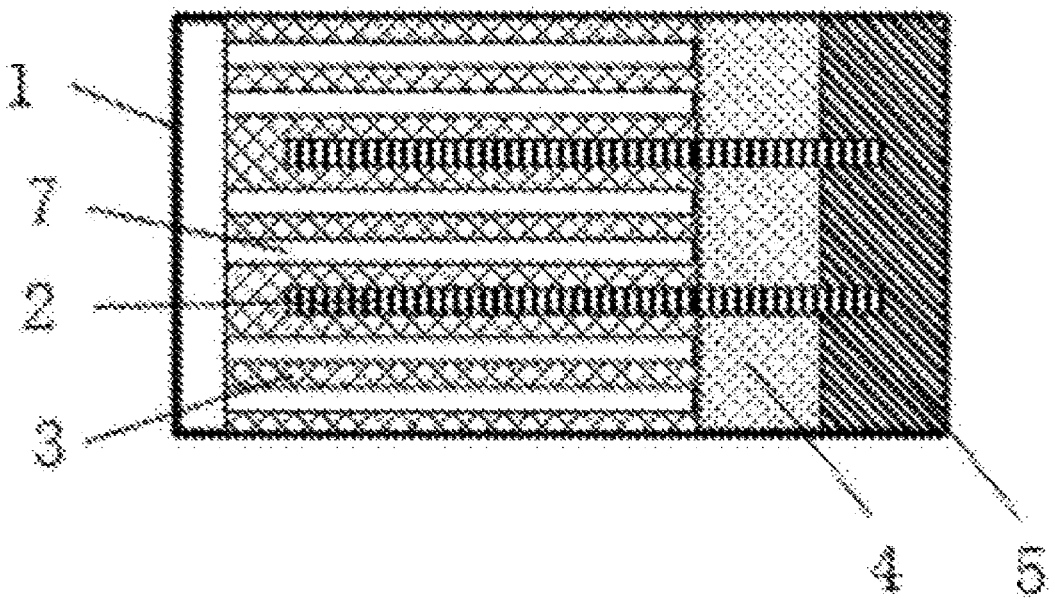
FIG. 3 is a main sectional view of an evaporator of the present disclosure.
Figure 4:
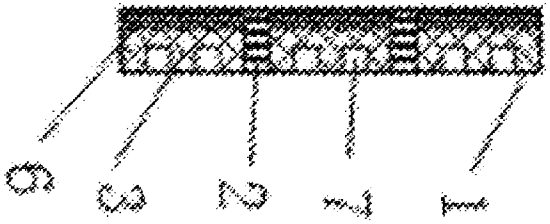
FIG. 4 is a left sectional view of an evaporator of the present disclosure.

The structure of the evaporator is shown in FIG. 3, comprising a housing 1 and a capillary wick arranged inside the housing 1.

The structure of the housing 1 takes into account the requirements for both positive pressure withstanding ability and uniform liquid supply, and the housing 1 is of a rectangular structure with two ends open and the inside provided with reinforcing ribs 2. Specifically, two reinforcing ribs 2 are arranged in the housing 1 in parallel along a height direction, and the width of the reinforcing ribs 2 is consistent with the width of the housing 1. The reinforcing ribs 2 are located at the middle section of the evaporator, that is, the length of the reinforcing ribs 2 is smaller than the length of the housing 1 of the evaporator, the two ends of each reinforcing rib 2 do not extend out of the housing 1, and the regions, with no reinforcing rib 2 arranged, at the two inner ends of the housing 1 are through spaces. When the capillary wick fills the housing 1, the capillary wick in the through spaces can carry out self-regulation of flow to realize uniform liquid supply, the reinforcing ribs 2 at the middle section ensure that the strength of the whole evaporator meets the requirement for withstanding positive pressure, and the thickness and spacing of the reinforcing ribs 2 should be determined through mechanical analysis according to the pressure in the working temperature region of a working fluid and based on the physical properties of the material.

The capillary wick is of a rectangular structure consistent with an inner cavity structure of the housing 1 as a whole, and is composed of four parts, namely, an evaporating wick 3, a heat insulating wick 4, a sealing wick 5 and a transfer wick 6. In a length direction of the capillary wick, the evaporating wick 3, the heat insulating wick 4 and the sealing wick 5 are arranged in sequence. The evaporating wick 3 is formed by sintering or pressing of powder with high thermal conductivity (such as copper and nickel) and small particle sizes, and powder with small particle sizes can provide small capillary pore diameters, thus providing large capillary force. The end surface, connected with a vapor line, of the evaporating wick 3 is taken as a left end surface, and the end surface opposite to the left end surface is taken as a right end surface (a reservoir is arranged on the right side of the evaporator); and grooves formed in the front end surface of the evaporating wick 3 are vapor channels 7, and two ends of the vapor channels 7 extend to the left end surface and the right end surface of the evaporating wick 3 respectively. When in use, a wall surface, opposite to the vapor channels 7, of the evaporator is attached to a heating device for absorbing the heat of the device. A space between the left end surface of the evaporating wick 3 and the housing 1 is an air accumulation chamber.

Figure 5:
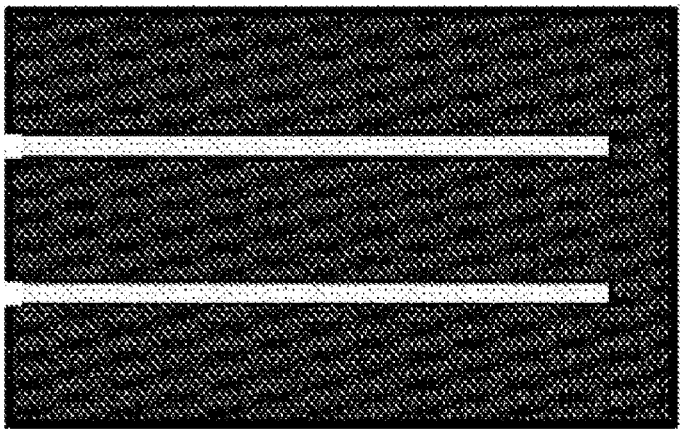
FIG. 5 is a structural schematic diagram of high-permeability metal sintered felt or screen with an integrated special-shaped structure.
Figure 6:
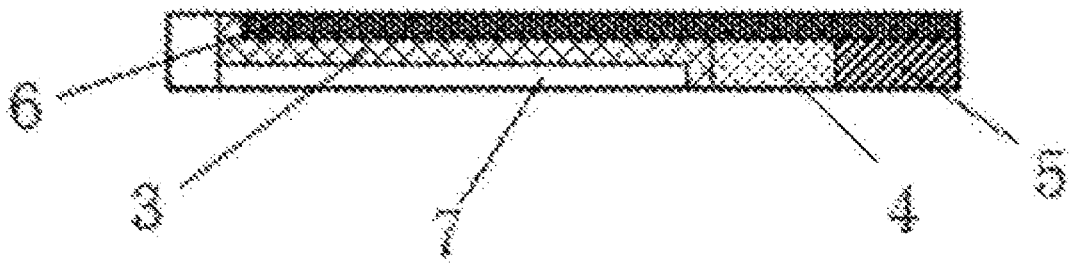
FIG. 6 is a top sectional view of an evaporator when a transfer wick is made of metal sintered felt or screen with an integrated special-shaped structure.
Figure 7:
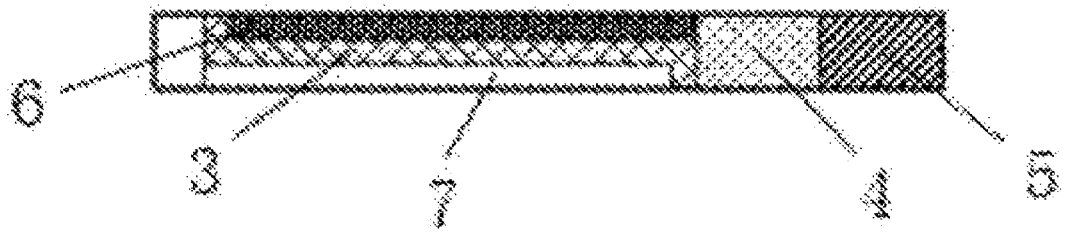
FIG. 7 is a top sectional view of an evaporator when a transfer wick is formed by sintering or pressing of powder with large particle sizes.

The transfer wick 6 is attached to the rear end surface of the evaporating wick 3 (i.e., the end surface opposite to the surface where the vapor channels 7 are located) to realize low-flow-resistance liquid transfer from the reservoir to the evaporating wick 3. Since the width of the reinforcing ribs 2 is consistent with the width of the housing 1, the reinforcing ribs 2 extend to the transfer wick 6 in a width direction. The transfer wick 6 can be directly made of high-permeability metal sintered felt or screen with an integrated special-shaped structure and directly inserted into the housing, as shown in FIG. 5 (grooves therein are used for accommodating the reinforcing ribs 2), or the transfer wick can be formed by sintering or pressing of powder with low thermal conductivity and large particle sizes. The end of the transfer wick 6 proximal to the air accumulation chamber does not penetrate through the evaporating wick 3 but is wrapped by the evaporating wick 3, thereby ensuring that the evaporating wick 3 is capable of providing circulating capillary driving force. When the metal sintered felt or screen with an integrated special-shaped structure is used, the other end of the transfer wick 6 can directly penetrate through the whole structure of the capillary wick to extend to the reservoir, as shown in FIG. 6, or can only extend to the heat insulating wick 4; and when sintering or pressing of powder with large particle sizes is conducted, the transfer wick 6 only extends to the heat insulating wick 4, as shown in FIG. 7.

The function of the heat insulating wick 4 is to block or reduce heat leakage from the evaporator to the reservoir, while not increasing the flow resistance of liquid from the reservoir to the evaporator. The heat insulating wick 4 should be a powder layer with low thermal conductivity and large particle sizes, such as stainless steel, titanium and titanium alloy or polytetrafluoroethylene powder. The heat insulating wick 4 may be in a loose state, or may be sintered or pressed.

The function of the sealing wick 5 is to seal the loose powder of the heat insulating wick 4 between the transfer wick 6 and the sealing wick 5, and if the heat insulating wick 4 has strength after being formed, the sealing wick 5 is not needed anymore. When the heat insulating wick 4 is in a loose state, the sealing wick 5 is required. If the metal sintered felt or screen is used as the transfer wick 6, the particle size of the powder used for the sealing wick 5 is not limited as long as a sealing effect can be achieved after sintering or pressing. If the transfer wick 6 is formed by powder sintering or pressing, the sealing wick 5 should be made of a material with large particle sizes to improve permeability and reduce the flow resistance of liquid supplied from the reservoir to the evaporator.

Embodiment 2

This embodiment provides a processing method of a positive-pressure-withstanding high-power flat loop heat pipe evaporator, and a transfer wick 6 in the evaporator uses metal sintered felt or screen.

Raw materials include a housing, a screen or sintered felt, powder required for a heat insulating wick, powder required for an evaporating wick, powder required for a sealing wick, a limiting tool and vapor channel tools.

Figure 8A:
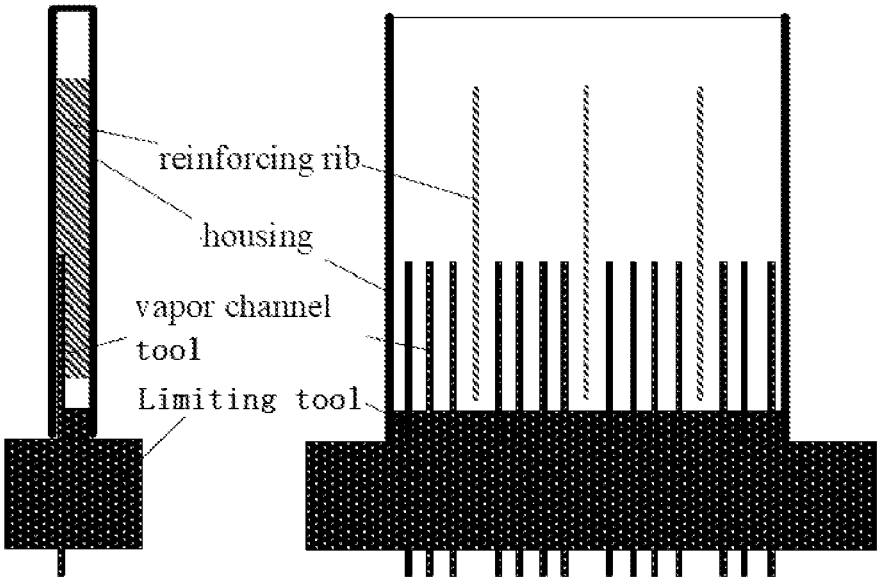
FIGS. 8A-8F show the manufacturing process of a flat loop heat pipe evaporator when a transfer wick is made of metal sintered felt or screen.

(1) The vapor channel tools (metal wires) are vertically placed on a boss located on the upper surface of the limiting tool, and then the housing (integrated with reinforcing ribs) is installed on the boss located on the upper surface of the limiting tool (after evaporator processing is completed, the space inside the housing occupied by the boss is an air accumulation chamber) such that the vapor channel tools are all positioned in the housing, and the vapor channel tools are attached to the end surface of one side of the housing, as shown in FIG. 8A.

Figure 8B:
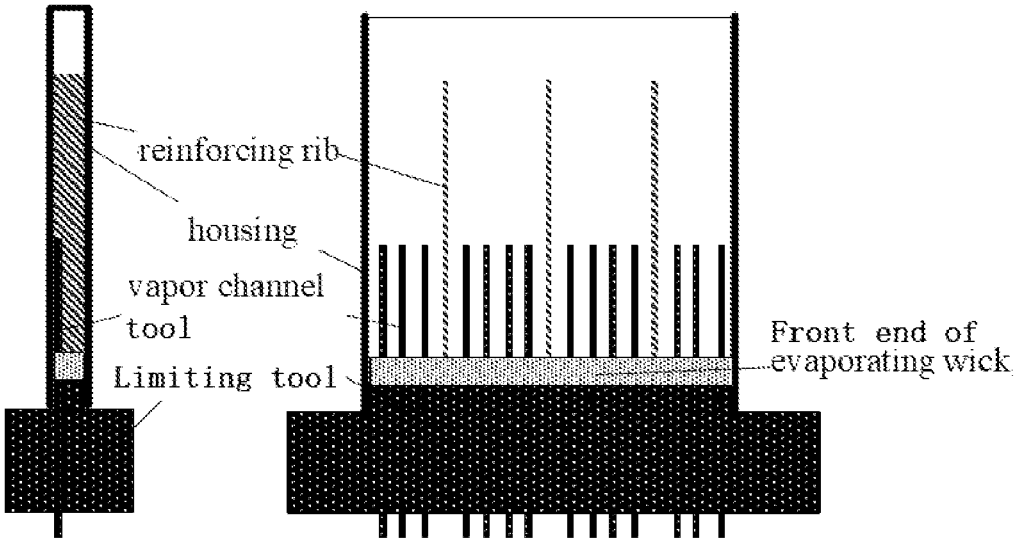

(2) The housing is filled with the powder for the evaporating wick, so as to form a front end of the evaporating wick, as shown in FIG. 8B, wherein the powder filling thickness is 5 mm, and the pressure is 90-120 MPa.

Figure 8C:
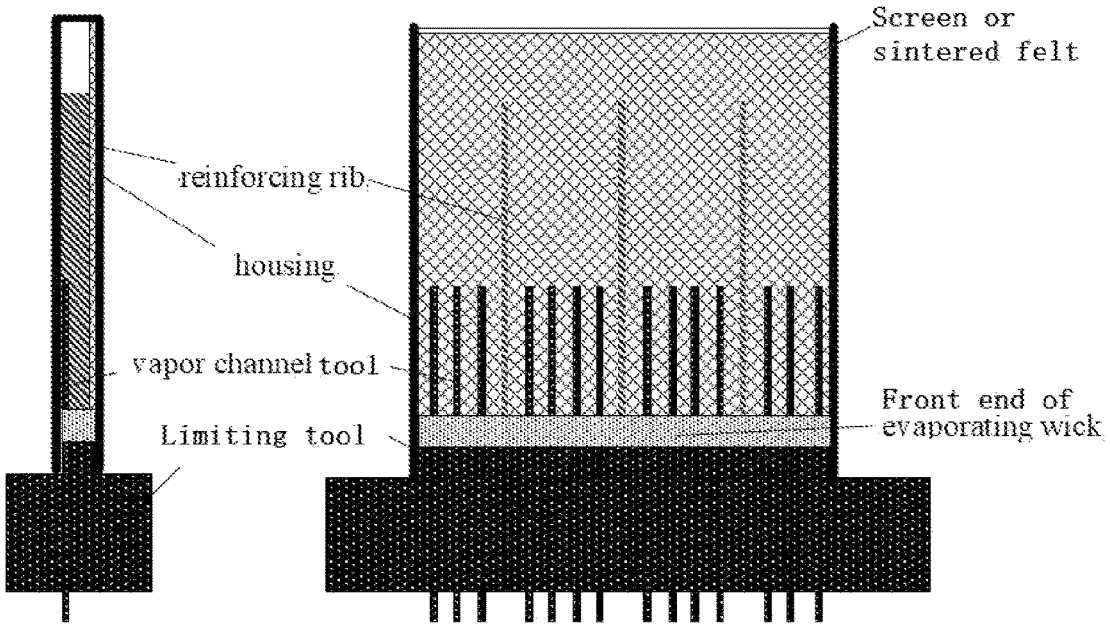

(3) The screen or sintered felt is cut into a size matched with the size of the inner wall of the housing, then inserted into the housing, and attached to a side opposite to the vapor channel tools to serve as a transfer wick, as shown in FIG. 8C.

Figure 8D:
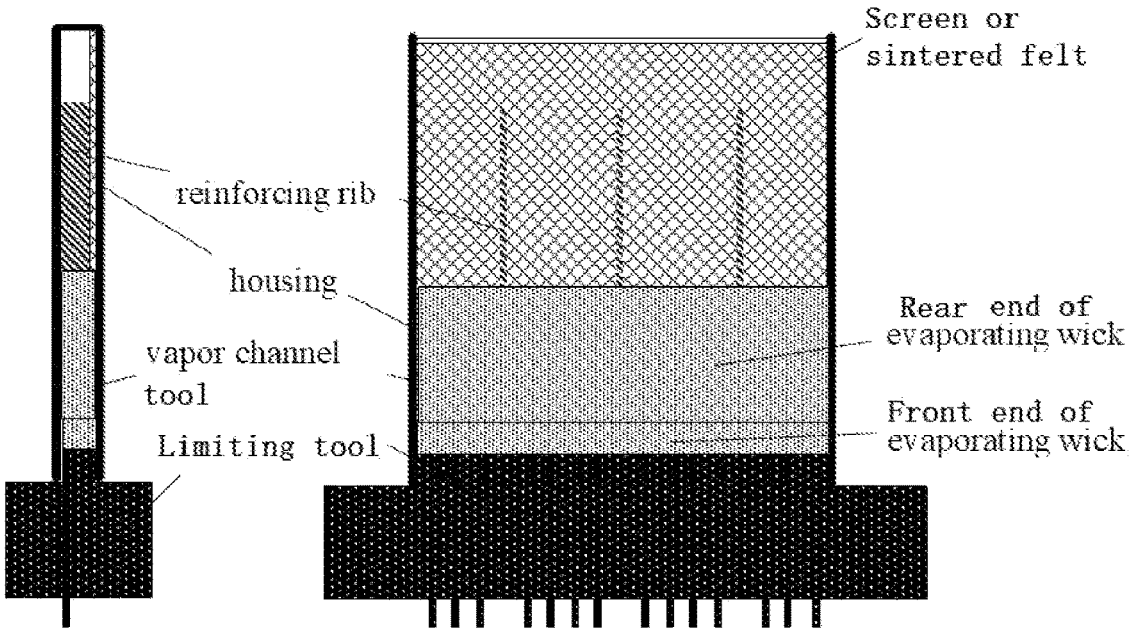

(4) The powder required for the evaporating wick is continued to be filled into the housing until the powder is flush with the tops of the vapor channel tools, so as to form a rear end of the evaporating wick, as shown in FIG. 8D; and the front end of the evaporating wick and the rear end of the evaporating wick together form the evaporating wick.

Figure 8E:
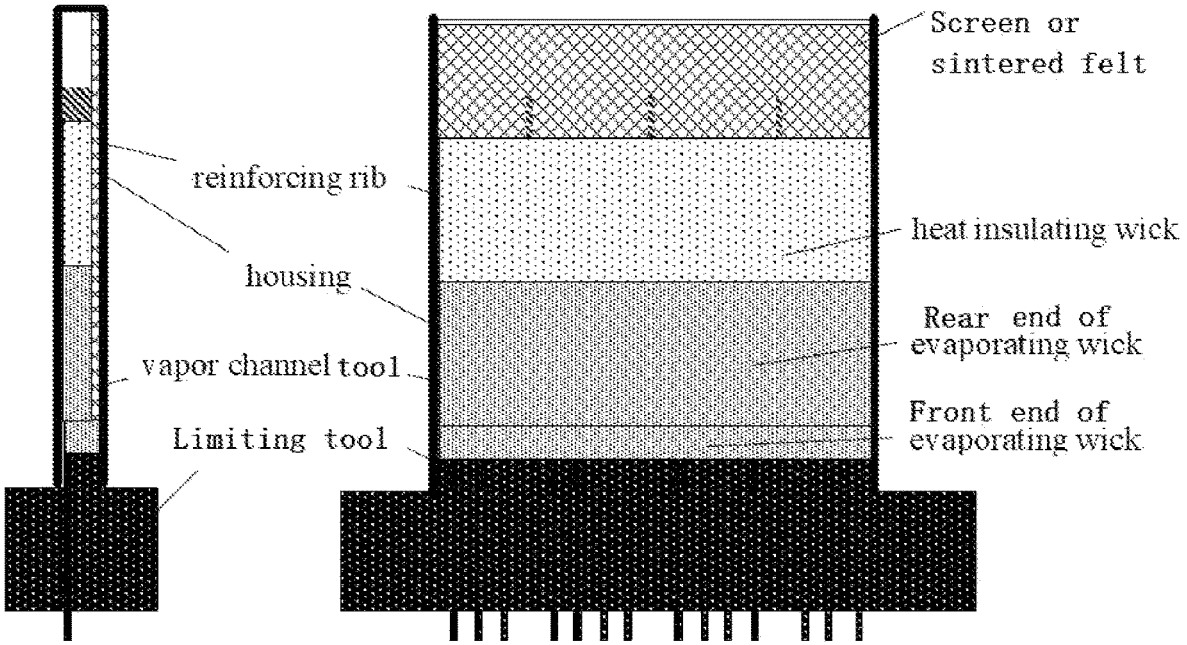

(5) The housing is filled with the powder required for the heat insulating wick above the evaporating wick to a thickness of 2-5 mm, so as to form the heat insulating wick, as shown in FIG. 8E.

Figure 8F:
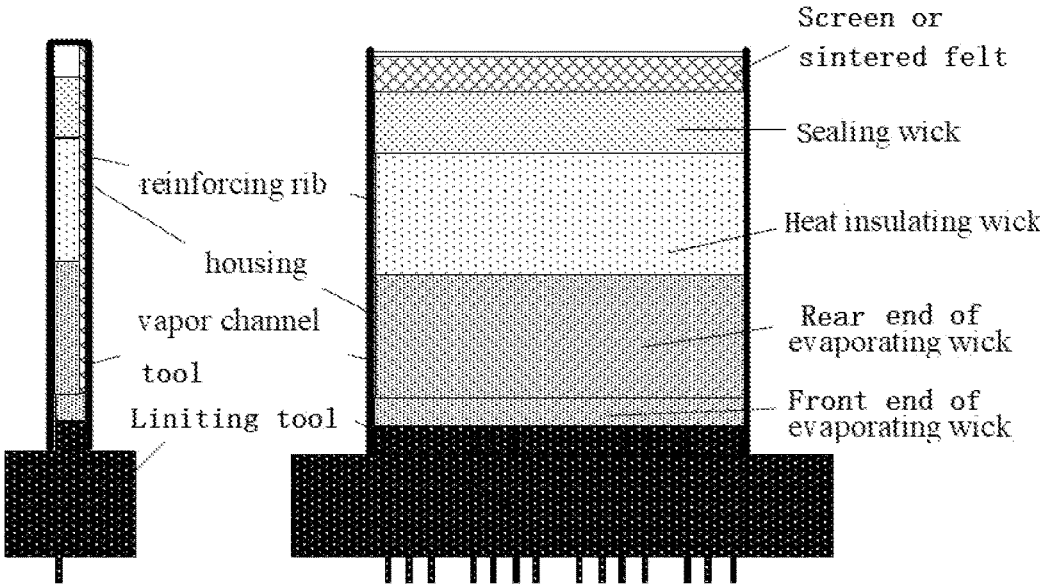

(6) The housing is filled with the powder required for the sealing wick above the heat insulating wick to a thickness of 3 mm, and under a pressure of 90-120 MPa, the sealing wick is formed, as shown in FIG. 8F.

(7) If the powder needs to be sintered, a product formed above is entirely put into a high-temperature furnace, so as to be sintered based on a sintering temperature of the powder; and if the powder is to be directly pressed, sintering is not required, and the next step is carried out.

(8) demolding is carried out to obtain the evaporator.

Embodiment 3

This embodiment provides a processing method of a positive-pressure-withstanding high-power flat loop heat pipe evaporator, and a transfer wick 6 in the evaporator is formed by powder sintering or pressing.

Raw materials include a housing, powder required for the transfer wick, powder required for a heat insulating wick, powder required for an evaporating wick, a limiting tool, a space occupying tool and vapor channel tools.

Figure 9A:
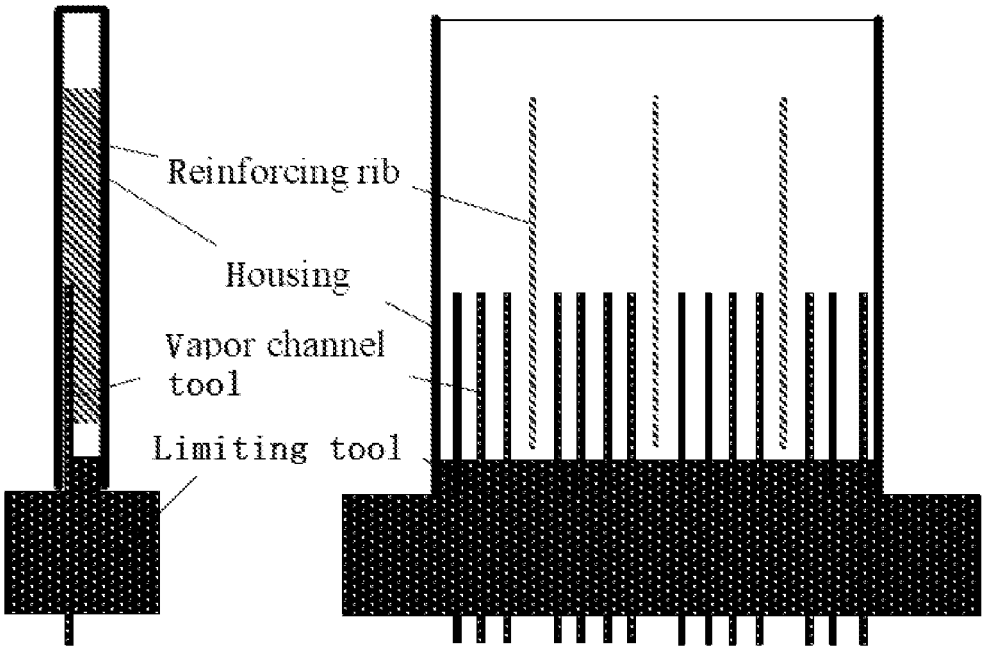
FIGS. 9A-9F show the manufacturing process of a flat loop heat pipe evaporator when a transfer wick is formed by sintering or pressing of powder.

(1) The limiting tool is assembled with the vapor channel tools (that is, the vapor channel tools are vertically placed on a boss located on the upper surface of the limiting tool), and then the housing is installed on the boss located on the upper surface of the limiting tool such that the vapor channel tools are all positioned in the housing, and the vapor channel tools are attached to the end surface of one side of the housing, as shown in FIG. 9A.

Figure 9B:
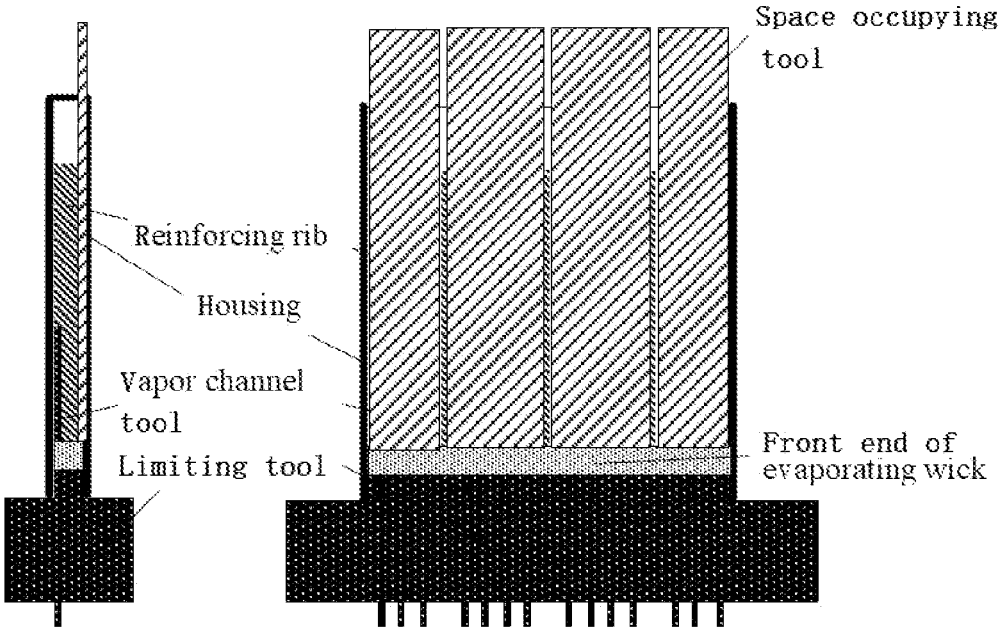

(2) The housing is filled with the powder required for the evaporating wick to a thickness of 5 mm, and under a pressure of 90-120 MPa a front end of the evaporating wick is formed, as shown in FIG. 9B.

(3) The space occupying tool is inserted into the housing and attached to a side opposite to the vapor channel tools in the housing, as shown in FIG. 9B, wherein the space occupying tool is used for occupying the space for the transfer wick in advance, and the size of the space occupying tool is the same as the size of the transfer wick.

Figure 9C:
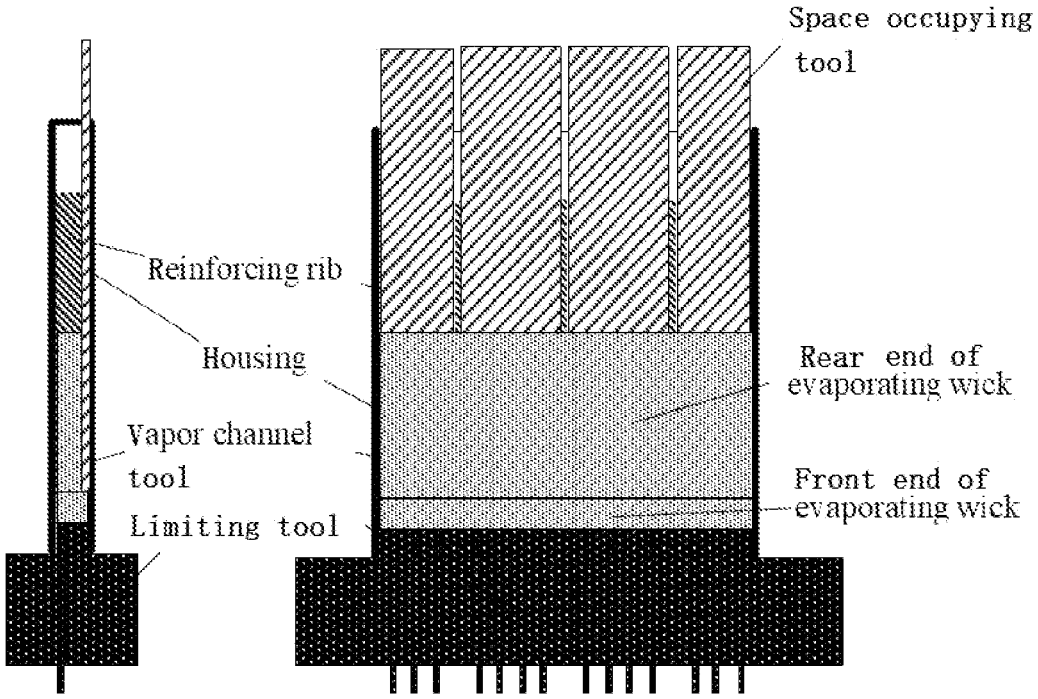

(4) The powder required for the evaporating wick is continued to be filled into the housing until the powder is flush with the tops of the vapor channel tools, so as to form a rear end of the evaporating wick, as shown in FIG. 9C; and the front end of the evaporating wick and the rear end of the evaporating wick together form the evaporating wick.

(5) If the powder required for the evaporating wick needs to be sintered, sintering of the evaporating wick is carried out in this state, the sintering process is conducted according to a sintering process of the actually used powder, and if sintering is not required, the next step is carried out.

Figure 9D:
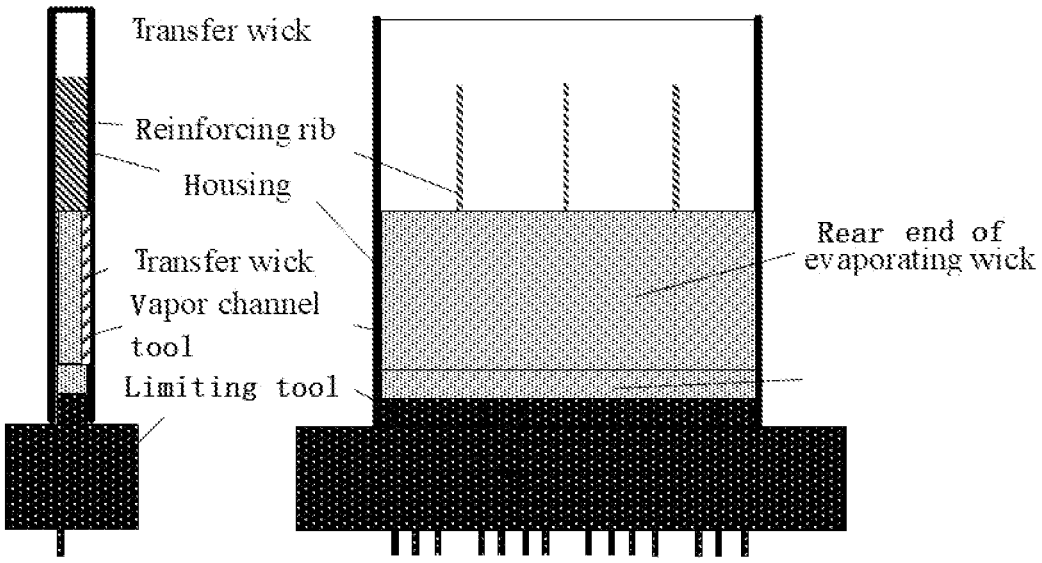

(6) The space occupying tool is removed, the powder required for the transfer wick is put in the original position of the space occupying tool, and the filling height is consistent with the height of the evaporating wick formed in step (4), so as to form the transfer wick, as shown in FIG. 9D.

Figure 9E:
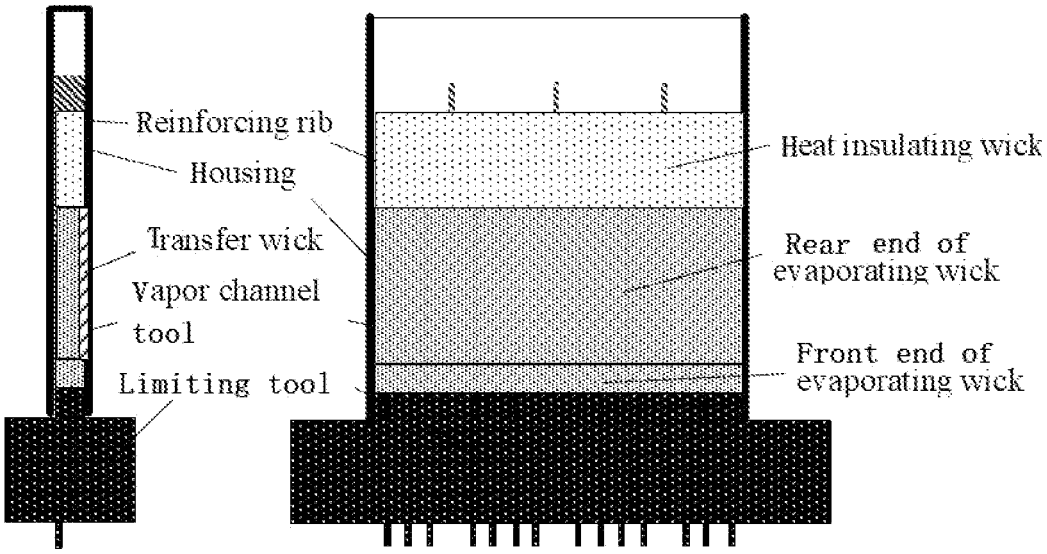

(7) The housing is filled with the powder required for the heat insulating wick above the evaporating wick to a thickness of 2-5 mm, so as to form the heat insulating wick, as shown in FIG. 9E.

Figure 9F:
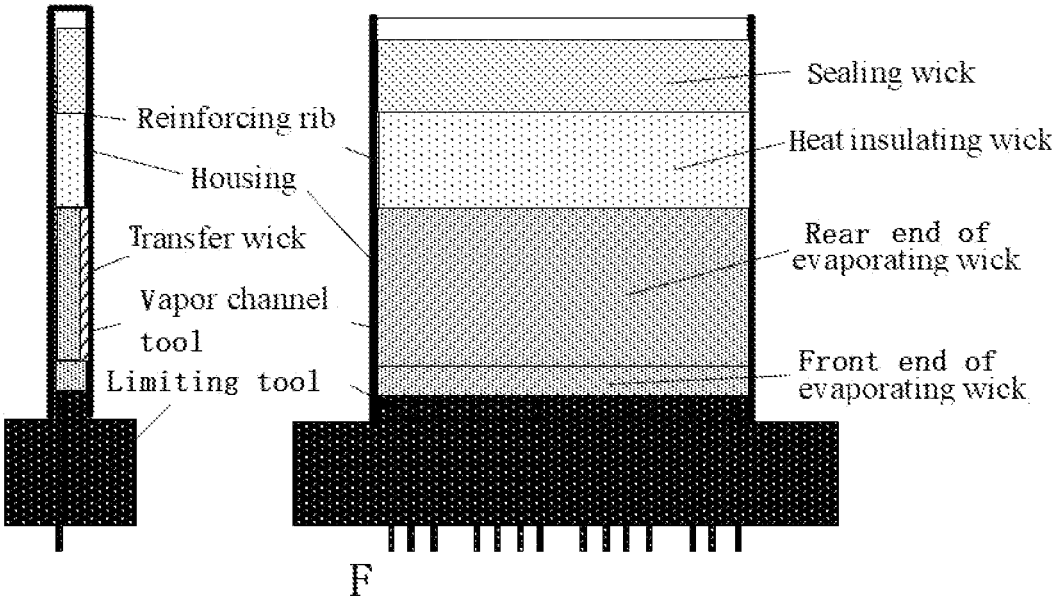

(8) The housing is filled with powder required for a sealing wick above the heat insulating wick to a thickness of 2-5 mm, and under a pressure of 90-120 MPa the sealing wick is formed, as shown in FIG. 9F.

(9) If the powder required for the sealing wick needs to be sintered, powder sintering is carried out in this state, the sintering process is conducted according to a sintering process of the powder required for the sealing wick, and if sintering is not required, the next step is carried out.

(10) Demolding is carried out to obtain the evaporator.

Embodiment 4

This embodiment provides a positive-pressure-withstanding high-power flat loop heat pipe, comprising an evaporator, a condenser, a reservoir, a vapor line and a liquid line. The evaporator is the evaporator in Embodiment 1, which is manufactured according to the method in Embodiment 2 or 3.

In summary, the above description is only the preferred embodiments of the present disclosure and is not intended to limit the protection scope of the present disclosure. Any modification, equivalent replacement and improvement made within the spirit and principle of the present disclosure shall fall within the protection scope of the present disclosure.

The invention claimed is:

1. A positive-pressure-withstanding high-power flat evaporator, comprising a housing and a capillary wick arranged inside the housing (1), wherein one or more reinforcing ribs (2) are arranged inside the housing (1), and the reinforcing ribs (2) are positioned at the middle section of the housing (1) wherein the two ends of each reinforcing rib (2) in a length direction do not extend out of the housing (1);

the capillary wick is of a rectangular structure consistent with an inner cavity structure of the housing (1), and comprises an evaporating wick (3), a heat insulating wick (4) and a transfer wick (6); wherein the evaporating wick (3) is used for providing capillary force, and vapor channels (7) having the same length as the evaporating wick (3) are arranged on the end surface of one side of the evaporating wick (3);

wherein an air accumulation chamber is defined by a space formed by a gap between one end of the evaporating wick (3) in a length direction and the inner surface of the housing (1); and the other end of the evaporating wick (3) in the length direction is provided with the heat insulating wick (4) for blocking heat leakage from the evaporator to a reservoir;

wherein the transfer wick (6) is arranged on a surface of the evaporating wick (3) opposite to the surface on which the vapor channels (7) are positioned, and the transfer wick (6) is used for realizing low-flow-resistance liquid transfer from the reservoir to the evaporating wick (3); and the end of the transfer wick (6) proximal to the air accumulation chamber side does not penetrate through the evaporating wick (3) and is wrapped by the evaporating wick (3).

2. The positive-pressure-withstanding high-power flat evaporator according to claim 1, further comprising a sealing wick (5) arranged at the end of the heat insulating wick (4) for sealing the heat insulating wick (4).

3. The positive-pressure-withstanding high-power flat evaporator according to claim 1, wherein the transfer wick (6) is a metal sintered felt or a screen.

4. The positive-pressure-withstanding high-power flat evaporator according to claim 1, wherein the transfer wick (6) is formed by powder sintering or pressing.

5. The positive-pressure-withstanding high-power flat evaporator according to claim 3, wherein the end of the transfer wick (6) distal to the air accumulation chamber extends through the entire capillary wick to the reservoir or to a point where the evaporating wick (3) and the heat insulating wick (4) are butted.

6. The positive-pressure-withstanding high-power flat evaporator according to claim 4, wherein the end, away from the air accumulation chamber, of the transfer wick (6) extends to a point where the evaporating wick (3) and the heat insulating wick (4) are butted.

7. The positive-pressure-withstanding high-power flat evaporator according to claim 1, wherein the evaporating wick (3) is formed by sintering or pressing of powder with high thermal conductivity and small particle sizes, and the heat insulating wick (4) is a powder layer with low thermal conductivity and large particle sizes.

8. A positive-pressure-withstanding high-power flat loop heat pipe, comprising an evaporator, a condenser, a reservoir, a vapor line and a liquid line, wherein the evaporator is the positive-pressure-withstanding high-power flat evaporator according to claim 1.

* * * * *